US010870300B2

(12) United States Patent
Briggs et al.

(10) Patent No.: US 10,870,300 B2
(45) Date of Patent: Dec. 22, 2020

(54) METHOD FOR PRINTING IMAGES

(71) Applicant: Multi Packaging Solutions, Inc., Lansing, MI (US)

(72) Inventors: Lyle Briggs, Lansing, MI (US); Lori MacCumber, Lansing, MI (US); Gregory Chup, Lansing, MI (US)

(73) Assignee: MULTI PACKAGING SOLUTIONS, INC., Lansing, MI (US)

( * ) Notice: Subject to any disclaimer, the term of this patent is extended or adjusted under 35 U.S.C. 154(b) by 0 days.

(21) Appl. No.: 16/314,962

(22) PCT Filed: Aug. 2, 2017

(86) PCT No.: PCT/US2017/045012

§ 371 (c)(1),
(2) Date: Jan. 3, 2019

(87) PCT Pub. No.: WO2018/026879

PCT Pub. Date: Feb. 8, 2018

(65) Prior Publication Data

US 2019/0248161 A1 Aug. 15, 2019

Related U.S. Application Data

(60) Provisional application No. 62/370,025, filed on Aug. 2, 2016.

(51) Int. Cl.
*B41M 3/00* (2006.01)
*B44F 7/00* (2006.01)
(Continued)

(52) U.S. Cl.
CPC ..... *B41M 3/00* (2013.01); *B41J 11/0015* (2013.01); *B41M 3/008* (2013.01); *B41M 3/06* (2013.01); *B44F 7/00* (2013.01); *B41M 1/04* (2013.01)

(58) Field of Classification Search
CPC ..... B41J 11/0015; B44F 7/00; B41M 3/06; B41M 1/04; B41M 3/00; B41M 3/008
See application file for complete search history.

(56) References Cited

U.S. PATENT DOCUMENTS

2005/0219626 A1 10/2005 Moncrieff
2015/0290926 A1* 10/2015 Branca ..... C11D 17/042 428/195.1

(Continued)

FOREIGN PATENT DOCUMENTS

EP 2803497 A1 11/2014
EP 3064365 A1 9/2016

(Continued)

OTHER PUBLICATIONS

PCT Search Report & Written Opinion dated Dec. 4, 2017, Application No. PCT/US2017/045012.

*Primary Examiner* — Justin Seo
(74) *Attorney, Agent, or Firm* — The Dobrusin Law Firm, P.C.; Bryan S. Lemanski

(57) ABSTRACT

A method for creating a greater pattern (12) comprising creating a first repeating line pattern (14*a*) comprising printing a first line (16*a*) onto a substrate, the first line having a weight of from about 0.2 point to about 0.6 point, printing a second line (16*b*) onto the substrate at least about 0.3 point and less than about 0.8 point from the first line (16*a*), the second line (16*b*) having a weight of from about 0.2 point to about 0.6 point, and printing a third line (16*c*) onto the substrate at least about 0.3 point and less than about 0.8 point from the second line (16*b*), the third line (16*c*) having a weight of from about 0.2 point to about 0.6 point, wherein the first, second and third lines (16*a*, 16*b*, 16*c*) are all printed at a first angle.

20 Claims, 6 Drawing Sheets

(51) Int. Cl.

| | |
|---|---|
| ***B41M 3/06*** | (2006.01) |
| ***B41J 11/00*** | (2006.01) |
| *B41M 1/04* | (2006.01) |

(56) References Cited

U.S. PATENT DOCUMENTS

| | | | |
|---|---|---|---|
| 2015/0293366 | A1 | 10/2015 | Lin |
| 2015/0304639 | A1 | 10/2015 | Lin |

FOREIGN PATENT DOCUMENTS

| | | | |
|---|---|---|---|
| JP | 2006123355 | A | 5/2006 |
| JP | 2007229967 | A | 9/2007 |
| JP | 2010264658 | A | 11/2010 |
| WO | 2015/062543 | A1 | 5/2015 |

* cited by examiner

METHOD FOR PRINTING IMAGES

FIELD OF THE INVENTION

The present teachings relate generally to printing methods, and more specifically to the printing of patterns where the patterns include a plurality of lines that are formed and printed for creating a visible effect on the surface which receives the printed patterns.

BACKGROUND OF THE INVENTION

There is a continued desire in the packaging marketplace for products that provide unique visual attributes to the exterior of a package. Such visual attributes are designed to attract the eye of a potential consumer. Accordingly, a number of developments have been made in the printing industry in an effort to print graphics that are unique and distinguishable from other printed materials.

Flexographic print processes are commonly utilized for creating printed images on certain types of substrates used for packaging. Such processes incorporate the use of a flexible relief plate and image areas are raised above the non-image areas on the flexible plate. The ink is transferred from an ink roll to an anilox roll and the substrate is located between the flexible plate and the roller to transfer the image. If a UV-curing ink is used, the ink is then cured by UV rays.

In combining these print processes, it would be desirable to provide methods of printing images that are printable when the processes are combined while resulting in images that appear to have depth and movement while minimizing undesirable blurring or bridging.

SUMMARY OF THE INVENTION

The teachings herein meet the above-identified need by providing useful methods for forming images, and more particularly for forming images that lend themselves flexographic and or UV cure print systems.

The teachings herein provide for a method for creating a greater pattern (e.g., a greater image) including creating a first repeating line pattern comprising printing a first line onto a substrate, the first line having a weight of from about 0.2 point to about 0.6 point; printing a second line onto the substrate at least about 0.3 point and less than about 0.8 point from the first line, the second line having a weight of from about 0.2 point to about 0.6 point; printing a third line onto the substrate at least about 0.3 point and less than about 0.8 point from the second line, the third line having a weight of from about 0.2 point to about 0.6 point; wherein the first, second and third lines are all printed at a first angle.

The greater pattern may include the first repeating line pattern and a second repeating line pattern. The second repeating line pattern may be printed at a second angle that differs from the first angle. The method may include coating the substrate using an anilox coater having a cell volume of less than about 19.5 cm3/m2. The method may include coating the substrate using an anilox coater having a cell volume of greater than about 15.5 cm3/m2. The first angle may be about 90° relative to a bottom edge of the greater pattern. The method may include coating the substrate with an anilox coater having a cell shape selected from hexagonal and diamond. The first line may have a weight of from about 0.3 point to about 0.5 point. The second line may have a weight of from about 0.3 point to about 0.5 point. The distance between the first line and second line may be from about 0.4 point to about 0.7 point. The distance between the second line and third line may be from about 0.4 point to about 0.7 point. The method may include creating a third repeating line pattern at a third angle, wherein the third angle is different from both the first and second angle. Each repeating line pattern within the greater pattern may include lines of the same weight. One or more repeating line patterns may include lines of a different weight as compared to an adjacent repeating line pattern.

The method may include creating a third repeating line pattern at a third angle, wherein the third angle is the same as the first angle. The method may include creating a third repeating line pattern that is adjacent the second repeating line pattern so that the second repeating line pattern lies in between the first repeating line pattern and third repeating line pattern. It is possible that no two adjacent repeating line patterns are drawn at the same angle. The shape of the first repeating line pattern may be the same as the shape of a second repeating line pattern. The shape of the first repeating line pattern may be different than the shape of the second repeating line pattern.

The teachings herein further provide for a printed item comprising a greater pattern including first repeating line pattern having, a first line having a weight of from about 0.2 point to about 0.6 point, a second line at least about 0.3 point and less than about 0.8 point from the first line, the second line having a weight of from about 0.2 point to about 0.6 point and a third line at least about 0.3 point and less than about 0.8 point from the second line. The third line may have a weight of from about 0.2 point to about 0.6 point. The printed item further includes a second repeating line pattern having a first line having a weight of from about 0.2 point to about 0.6 point, a second line at least about 0.3 point and less than about 0.8 point from the first line, the second line having a weight of from about 0.2 point to about 0.6 point, and a third line at least about 0.3 point and less than about 0.8 point from the second line, the third line having a weight of from about 0.2 point to about 0.6 point.

The first repeating line pattern may be located at a first angle and the second repeating line pattern is located at a second angle that differs from the first angle. The first angle may be about 90° relative to a bottom edge of the greater pattern. The first line may have a weight of from about 0.3 point to about 0.5 point. The distance between the first line and second line may be from about 0.4 point to about 0.7 point. The distance between the second line and third line may be from about 0.4 point to about 0.7 point. A third repeating line pattern may be at a third angle, wherein the third angle is different from both the first and second angle. Each repeating line pattern within the greater pattern may include lines of the same weight. One or more repeating line pattern may include lines of a different weight as compared to an adjacent repeating line pattern. A third repeating line pattern may be at a third angle, wherein the third angle is the same as the first angle. A third repeating line pattern may be adjacent the second repeating line pattern so that the second repeating line pattern lies in between the first repeating line pattern and third repeating line pattern. It is possible that no two adjacent repeating line patterns are located at the same angle. The shape of the first repeating line pattern may be the same as the shape of the second repeating line pattern. The shape of the first repeating line pattern may be different than the shape of the second repeating line pattern. The printed item may be a metal, a polymeric material, or a paperboard material. The printed item may be a paperboard material having a gauge of less than about 22 point.

The teachings herein provide for a system for printing patterns which creates an illusion of movement within the pattern based upon the weight of the printed lines, the distances between the printed lines, and the angles at which the lines are printed relative to one another.

DETAILED DESCRIPTION

Figure 1:
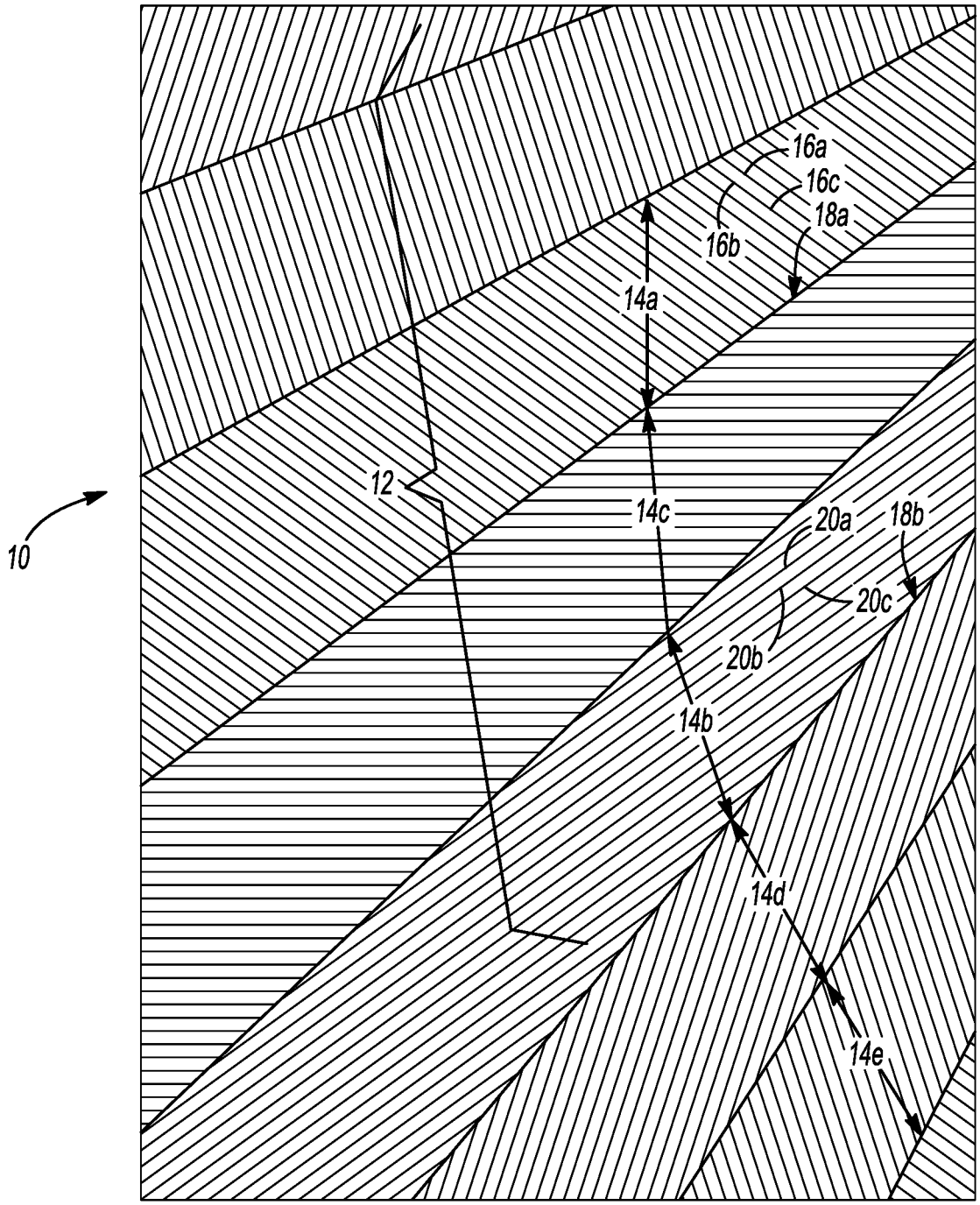
FIG. 1 is a magnified top down view of an illustrative example of patterns in accordance with the present teachings.

The teachings herein are directed toward print methods that utilize pattern formations having lines of specific weights, with specific distances formed in between the lines and specific angles at which the lines are drawn relative to one another.

This application claims the benefit of the filing date of U.S. Provisional Application Ser. No. 62/370,025, filed Aug. 2, 2016, the contents of these applications being hereby incorporated by reference herein for all purposes.

The patterns are preferably formed and then transmitted to a printing device so that they may be printed with specific inks onto a substrate of choice. The patterns may be hand-drawn or may be created via a computer-based program. The patterns may be some combination of hand drawn and created via a computing device.

A greater pattern may be formed by a plurality of repeating line patterns within the greater pattern. The greater pattern may include a first and second repeating line pattern and may be substantially free of any additional repeating line patterns. The greater pattern may include a first, second and third repeating line pattern and may be substantially free of any additional repeating line patterns. The greater pattern may include a fourth, fifth, sixth, seventh, or any number of repeating line patterns within the greater pattern. Each repeating line pattern may be distinguishable from other repeating line patterns by the angle at which the repeating lines are drawn, by the weight of the lines, by the distance between the lines or by some combination thereof.

The distance between each adjacent lines in any repeating line pattern may be from about 0.3 point to about 0.8 point. The distance between each adjacent lines in any repeating line pattern may be from about 0.4 point to about 0.7 point. While it is possible that smaller or greater distances in between adjacent lines may be utilized, smaller distances increase the possibility of lines blurring together, whereas larger distances may decrease the ability of the patterns to have the desired visual effect of motion within the patterns.

The weight of each line may be from about 0.2 point to about 0.6 point. The weight of each line may be from about 0.3 point to about 0.5 point. It is possible that smaller or larger line weights may be utilized. Line weights that are too small or too large however, may limit the ability of the pattern to have the desired visual effect when viewed with the human eye.

Each repeating line pattern may be drawn as a series of lines which may be substantially parallel to one another. In other words, within one repeating line pattern each line follows along each adjacent line while maintaining a consistent distance from each adjacent line. As one non-limiting example, if a repeating line pattern includes a plurality of lines having a distance of 0.5 point between each line, each line will remain 0.5 point from the line on either side (e.g., any adjacent line). Through any curves, in the repeating line pattern, the lines will still remain 0.5 point from any adjacent line.

It is possible that each repeating line pattern may be selected to have one of the following spacing arrangements. For example a repeating line pattern may have an arrangement of a 0.35 point line followed by a 0.35 point space, followed by a second 0.35 point line. A repeating line pattern may have an arrangement of a 0.35 point line followed by a 0.437 point space, followed by a second 0.35 point line. A repeating line pattern may have an arrangement of a 0.437 point line followed by a 0.437 point space, followed by a second 0.437 point line. A repeating line pattern may have an arrangement of a 0.48 point line followed by a 0.437 point space, followed by a second 0.48 point line. A repeating line pattern may have an arrangement of a 0.48 point line followed by a 0.48 point space, followed by a second 0.48 point line. A repeating line pattern may have an arrangement of a 0.48 point line followed by a 0.60 point space, followed by a second 0.48 point line. A repeating line pattern may have an arrangement of a 0.60 point line followed by a 0.48 point space, followed by a second 0.60 point line. A repeating line pattern may have an arrangement of a 0.60 point line followed by a 0.60 point space, followed by a second 0.60 point line. A repeating line pattern may have an arrangement of a 0.60 point line followed by a 0.75 point space, followed by a second 0.60 point line.

It is possible that different repeating line patterns within a greater pattern will still maintain the same distance between adjacent lines, such that any repeating line patterns within a greater pattern will maintain one consistent distance in between each adjacent lines. However, it is also possible that the different repeating line patterns within a greater pattern will have different distances between lines than an adjacent repeating line pattern. For example, a first repeating line pattern within a first greater pattern may have a distance in between each adjacent lines that is different from the distance in between adjacent lines of a second repeating line pattern within the first greater pattern. It is thus also possible that a third repeating line pattern within the first greater pattern may have a distance in between adjacent lines that is the same as the first repeating line pattern, the same as the second repeating line pattern, or completely different from either the first or the second repeating line pattern.

Within a single repeating line pattern, it is possible that the distance between adjacent lines remains the same throughout the entirety of the repeating line pattern. However, it is also possible that a single repeating line pattern within a greater pattern may include distances in between adjacent lines that are different from one another. For example, a first plurality of lines within a single repeating line pattern may have a first distance in between adjacent lines whereas a second plurality of lines within the single repeating line pattern may have a second distance in between adjacent lines. It is entirely possible that third distances, fourth distances, or any number of different distances exist within a single repeating line pattern.

It is possible that different repeating line patterns within a greater pattern will still maintain the same line weight for each line within the greater pattern, such that any repeating line patterns within a greater pattern will maintain one consistent line weight. However, it is also possible that the different repeating line patterns within a greater pattern will have different line weights than an adjacent repeating line pattern. For example, a first repeating line pattern within a first greater pattern may have a line weight that is different from the line weight of a second repeating line pattern within the first greater pattern. It is thus also possible that a third repeating line pattern within the first greater pattern may have a line weight that is the same as the first repeating line pattern, the same as the second repeating line pattern, or completely different from either the first or the second repeating line pattern.

Within a single repeating line pattern, it is possible that the line weight remains the same throughout the entirety of the repeating line pattern. However, it is also possible that a single repeating line pattern within a greater pattern may include line weights that are different from one another. For example, a first plurality of lines within a single repeating line pattern may have a first line weight whereas a second plurality of lines within the single repeating line pattern may have a second line weight. It is entirely possible that third line weights, fourth line weights, or any number of different line weights exist within a single repeating line pattern.

The repeating line patterns may have any shape. They may be formed as circles or ovals. They may have substantially rounded or curved edges, they may have substantially sharp edges, or they may have some combination thereof. They may be formed as circles or ovals, which may appear as concentric. They may be oblong. They may be formed as rectangles, starts, or any multi-sided shape. They may be relatively amorphous in shape. It is possible that each repeating line pattern may be such that every line forms the same shape as each adjacent line (e.g., to form concentric shapes). Thus, a greater pattern may be formed of a plurality of repeating line patterns that all have the same shape. A greater pattern may be formed of a plurality of repeating line patterns of differing shape. A greater pattern may be formed by some combination of repeating line patterns that include some repeating line patterns that form the same shape, and some repeating line patterns that form different shapes.

The teachings herein are directed to a printing process for creating the appearance of image movement. The process may include one or more of the following steps. An overall pattern (e.g., the greater pattern) is formed. The greater pattern may be formed as a general outline with minimal detail, but the location and patterns of the desired appearance of motion is identified in forming the greater pattern. The greater pattern is then broken into a plurality of repeating line patterns. The repeating line patterns may all be the same. The repeating line patterns may be selected from two or more distinct repeating line patterns. The repeating line patterns may be selected from any number of distinct repeating line patterns. It is possible that no two repeating line patterns are the same. The location and size of each repeating line pattern is then selected, as is the angles and shape for each repeating line pattern. It is possible that while two repeating line patterns in the greater pattern are the same in regard to line and space weight, the size, shape, angle or location may differ. It is also possible that each repeating line pattern that is the same as another repeating line pattern also has the same size, shape or angle. Or one or more of size, shape, and angle may be the same or different.

It is possible that the angle of each repeating line pattern may be selected such that certain repeating line patterns reflect light in a desired manner. Each repeating line pattern's angle may be different and thus may reflect light and movement depending upon its angle towards the ambient light around it. Each angle's intensity will reflect light relative to the intensity of the shape next to it at any given moment. As a result, it may be possible to determine which of the repeating line patterns that are should be "lit" (e.g., reflecting light) and then make form each of those repeating line patterns at the same angle. As one non-limiting example, a first repeating line pattern is formed at a 90° angle and then the appearance of movement is created movement by the number of different angled steps formed to return back to a 90°. The angles of each repeating line pattern relative to each other determines the type of movement (e.g. the appearance of on/off movement, slow sweeping movement, fast sweeping movement etc.).

After forming the images, the print process may utilize coating compositions such as those disclosed in U.S. Patent Publication Nos. 2015/0293366 and 2015/0304639, both incorporated by reference herein for all purposes. The print process may include the use of a first curable coating composition and a second curable coating composition. Both curable coating compositions may be optically transparent curable compositions. The first curable coating composition may comprise (i) at least one acrylate monomer, (ii) an acrylate terminated oligomer, with a backbone of an epoxy, polyester, urethane, acrylic, silicone and mixtures thereof, (iii) a photoinitiator, and (iv) a surface tension lowering additive. The cured first curable coating composition has a surface tension less than 32 dynes/cm$^2$ as measured by ASTM D7490-08. The second curable coating composite may comprise (i) at least one acrylate monomer, (ii) an acrylate terminated oligomer, with a backbone of an epoxy, polyester, urethane, acrylic, silicone and mixtures thereof, and (iii) a photoinitiator. The second curable coating composition has a liquid surface tension greater than at least 2 dynes/cm$^2$, as measured by ASTM D1084, than the surface tension of the cured first curable coating composition.

The print process may include a coating process utilizing a first curable coating composition that is applied on top of the greater image in a first pre-determined pattern; and a second curable coating composition that is applied on top of the printed image, wherein the second curable coating composition self-registers into a second pattern that does not overlap with the first pre-determined pattern. The first curable coating composition may comprise (i) at least one acrylate monomer, (ii) an acrylate oligomer with a backbone that comprises one or more groups selected from epoxy, polyester, urethane, acrylic and silicone, (iii) a photoinitiator, and (iv) a siloxane or silicone additive with a weight average molecular weight (Mw) less than 100,000 Daltons. The second curable coating composition may comprise (i) at least one acrylate monomer, (ii) an acrylate oligomer with a backbone that comprises one or more groups selected from epoxy, polyester, urethane, acrylic and silicone, (iii) a photoinitiator, and (iv) a self-assembling additive that prevents flow and promotes self-retracting.

An anilox coater may be utilized, the anilox coater including a plurality of cells located thereon. The cells of the anilox coater may have having a cell volume of less than about 19.5 cm$^3$/m$^2$. The cells of the anilox coater may have having a cell volume of greater than about 15.5 $cm^3/m^2$. The anilox coater may have a cell shape selected from hexagonal and diamond.

The substrate for receiving the images may be any substrate suitable for receiving printed matter, including metals, polymeric material, paperboard material, or the like. The substrate for receiving the printed matter may be a material pliable enough to be scored and folded but strong enough to withstand the weight of a contained item. The substrate may be formed of paper materials including but not limited to paperboard, chipboard, cardboard, fiberboard, natural fibers, mineral fibers or any combination thereof. The material may be a virgin material, a post-consumer recycled material, or both. The substrate material may be a recyclable material and/or a biodegradable material. If the substrate material includes paperboard, the paperboard may be a bleached or unbleached paperboard. For example it may be a solid bleached sulfate (SBS) paperboard. The material may contain a major portion that can be recycled. The base substrate material may be formed of a polymeric material including but not limited to thermoplastics, thermoset plastics, elastomeric containing materials or any combination thereof. Examples of polymeric materials that may be employed include polyamide, polyester, polystyrene, polyethylene (including polyethylene terephthlate, high density polyethylene and low density polyethylene), polypropylene, polyvinyl chloride, bio-based plastics/biopolymers (e.g., poly lactic acid), silicone, acrylonitrile butadiene styrene (ABS), or any combination thereof.

The gauge of the substrate material may vary depending on the size of the packaging of the desired strength of the packaging. As an example, if the substrate material includes paperboard, the gauge of the paperboard may be greater than about 10 point paperboard. The gauge of the paperboard may be less than about 22 point paperboard.

In order to form the patterns onto a substrate of choice a printing press may be utilized in accordance with the following steps. While the following describes a possible print process for the patterns, it is entirely possible that an alternative print process, and/or one or more differing print steps may be utilized to print the patterns.

The desired images are generated, by drawing, by digital creation, or by some combination thereof. The images include a greater image formed by a plurality of repeating line patterns as described above. Upon creation of the images, the images are printed onto a substrate. An example print process is described below.

A printing press that incorporates a UV curing step may be utilized for printing the patterns in accordance with the teachings herein. During printing, the patterns may be printed and then coated with a repellant UV matte varnish. The patterns may be printed and then coated with a repellant UV coating. The repellant UV matte varnish may be applied by a UV offset printing unit. The UV offset printing unit may be located adjacent and/or prior to a coater. The coater may be selected from a tower coater, a plate coater, a blanket coater, an ink train coater, or any combination thereof. The print process may be a flexographic and/or lithographic print process.

The UV repellant matte varnish may then be cured. The printed substrate may then travel to the coater device where a UV repellant gloss coating may be applied at a photopolymer plate. Based on the repellant characteristics of both the UV repellant gloss and the UV matte varnish, when the UV repellant gloss coating is applied over the UV matte varnish, it may roll off of the lenses into one or more valleys formed in the spaces between each lens.

EXAMPLE

A selected varnish unit is cleaned, deglazed and colorwashed. Roller settings are then adjusted to ensure proper varnish transfer to the substrate. An effect varnish is added to the ink fountain and the application is set with a low key setting of from about 10% to about 20%. An ink ball sweep setting of from about 60% to about 80% is used. A fountain solution recirculation system is drained and replenished to ensure that the fount is fresh and provides optimum ink/water balance. The entire UV coating system, anilox chamber, lines and pumps are cleaned and purged with UV wash and isopropyl alcohol.

A top coat is mixed well. One example is a gloss coating available from Novaset under the tradename 4210. The top coat is placed into the coater system. As the top coat fills the lines and chamber, it will purge the UV wash and isopropyl alcohol, ensuring that the entire coater system includes only top coat and is contaminate free. A return wand is placed into the top coat container to close the coating loop.

Next, only the varnish step is performed in an effort to determine the balance of the varnish on the substrate. Once a desirable amount of varnish is determined, the top coat is added. A first set of UV lamps is utilized after the varnish process, but before the top coat is provided. A second set of UV lamps is employed after the top coat process.

If there is an imbalance that results in a varnish shortage, bridging may occur. Bridging is visible when one or more parallel lines in a printed pattern appear to blend with one another. Such bridging may be remedied by increasing the amount of varnish during the varnish process.

Figure 2:
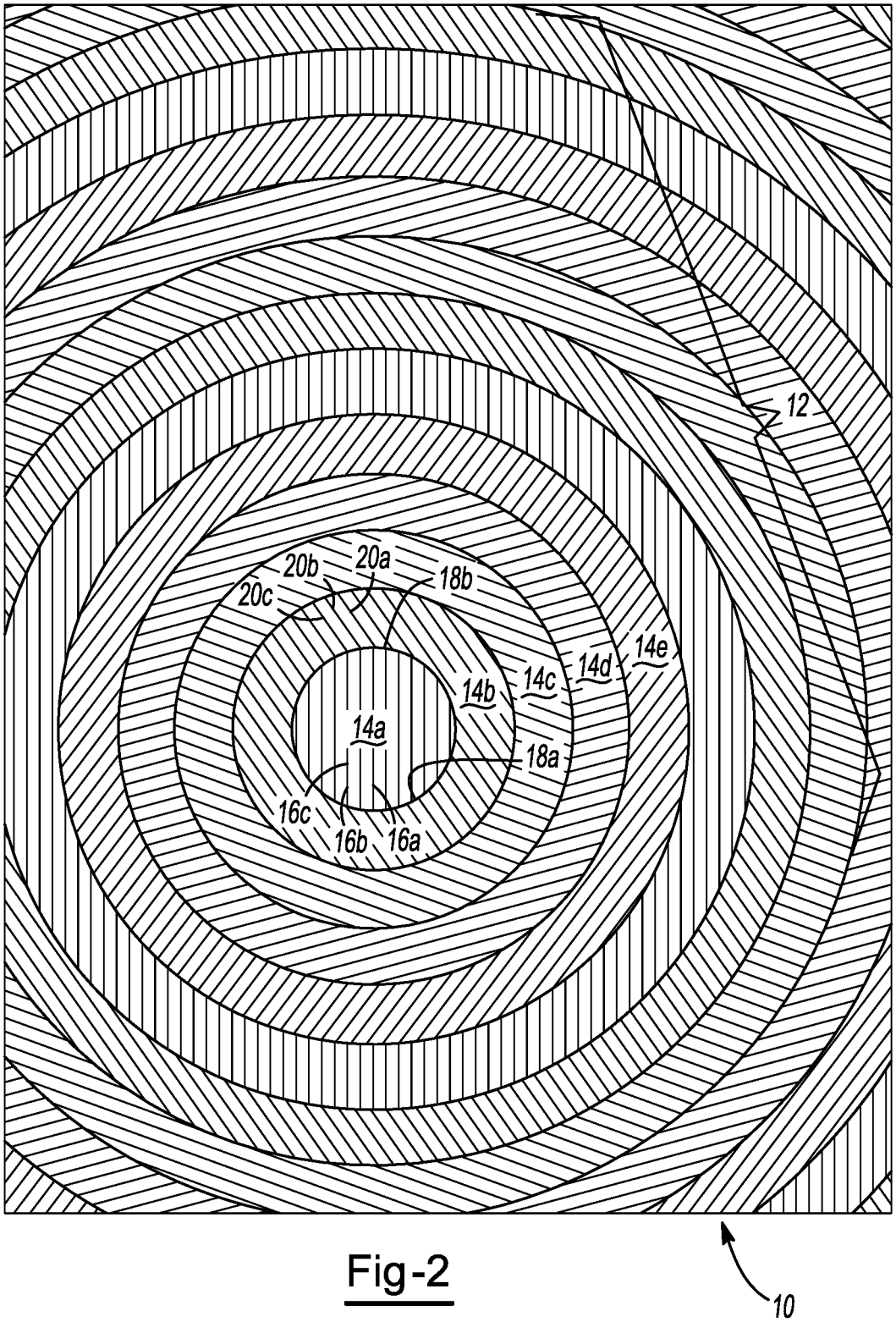
FIG. 2 is a magnified top down view of an illustrative example of patterns in accordance with the present teachings.

The teachings herein contemplate the structures and features depicted in the accompanying drawings. As shown for example in FIGS. 1 and 2, an image 10 may include a greater pattern 12 formed by a first repeating line pattern 14*a*, a second repeating line pattern 14*b*, a third repeating line pattern 14*c*, a fourth repeating line pattern 14*d*, a fifth repeating line pattern 14*e*, and a plurality of additional repeating line patterns. The distance between adjacent lines 16*a*, 16*b* of the first repeating line pattern is the same as the distance between adjacent lines 16*b* and 16*c*, and the distance is about 0.5 point. The weight of adjacent lines 16*a*, 16*b* and 16*c* is also the same and is about 0.4 point. The angles 18*a* formed by lines 16*a*, 16*b*, 16*c*, in the first repeating line pattern 14*a* are shown as differing from the angles 18*b* formed by the lines 20*a*, 20*b*, 20*c* in the second repeating line pattern 14*b* (when such angles are determined from a line bisecting the greater image).

Figure 3:
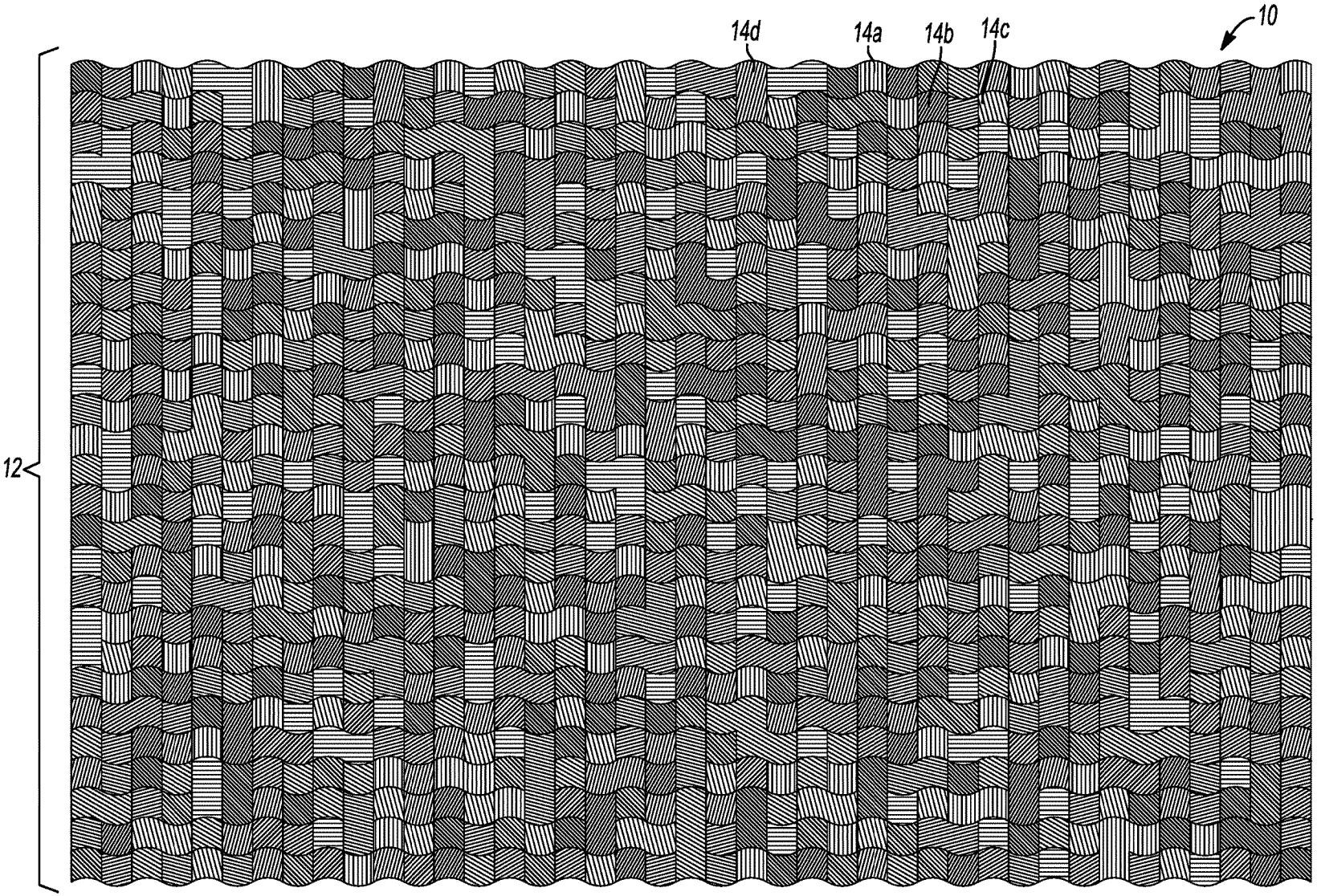
FIG. 3 is a top down view of a series of illustrative alternating repeating line patterns as part of a greater pattern in accordance with the present teachings.
Figure 4:
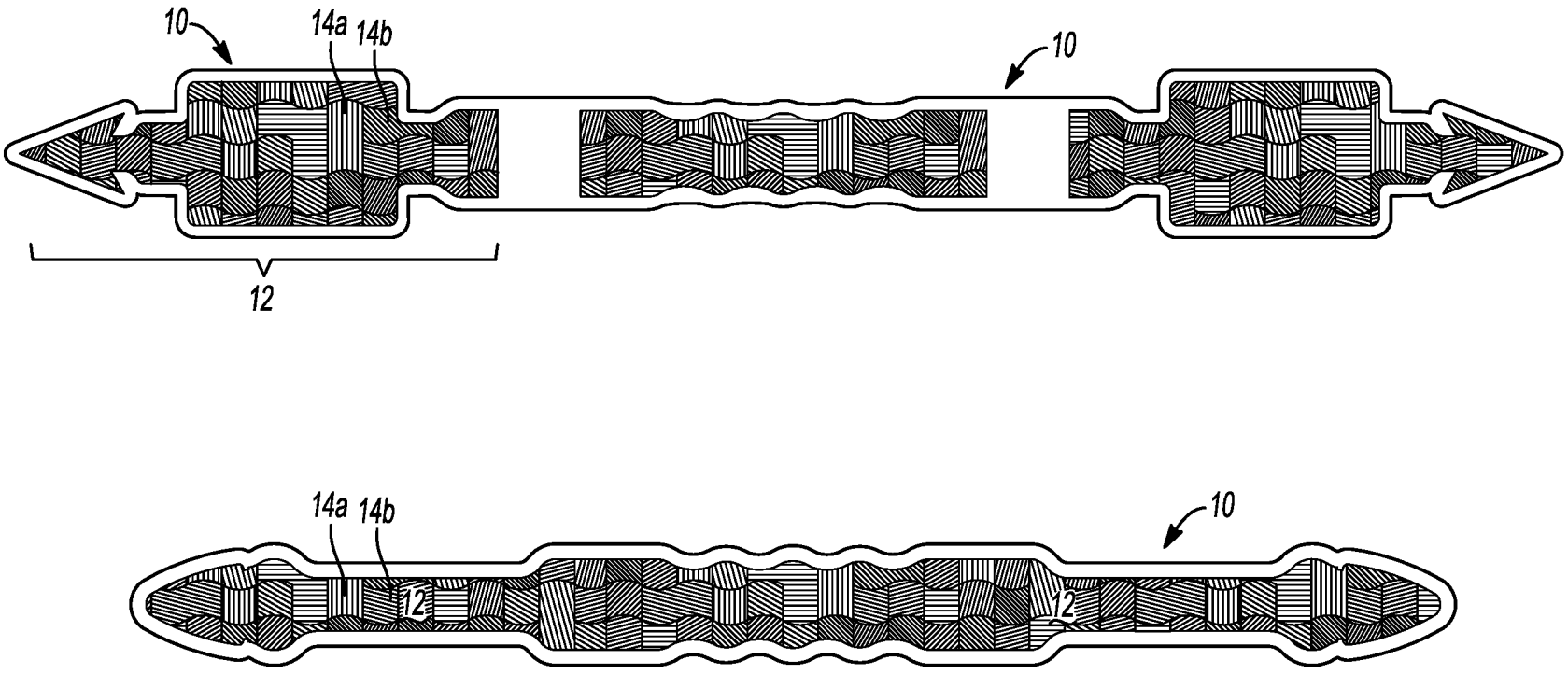
FIG. 4 is top down view of a paperboard handle including a series of illustrative alternating repeating line patterns as part of a greater pattern in accordance with the present teachings.
Figure 5C:
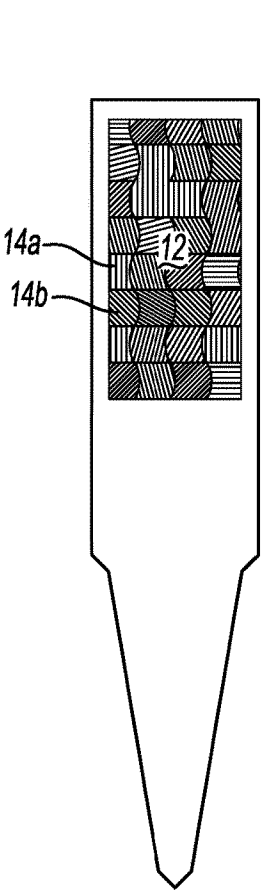
FIGS. 5A, 5B, 5C, 5D, 5E, and 5F are top down views of paperboard tags including a series of illustrative alternating repeating line patterns as part of a greater pattern in accordance with the present teachings.
Figure 5B:
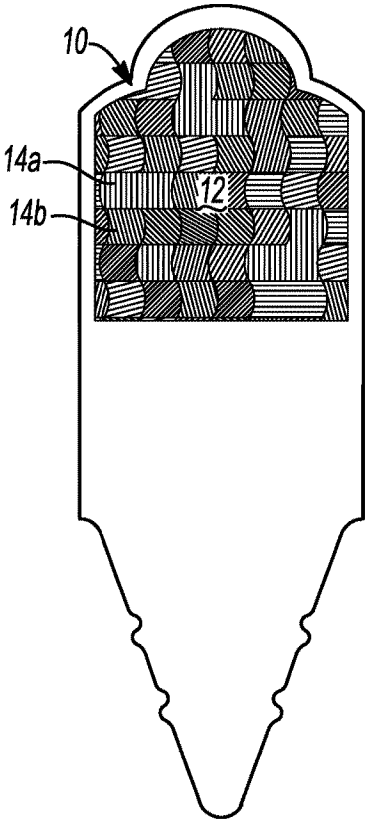
Figure 5A:
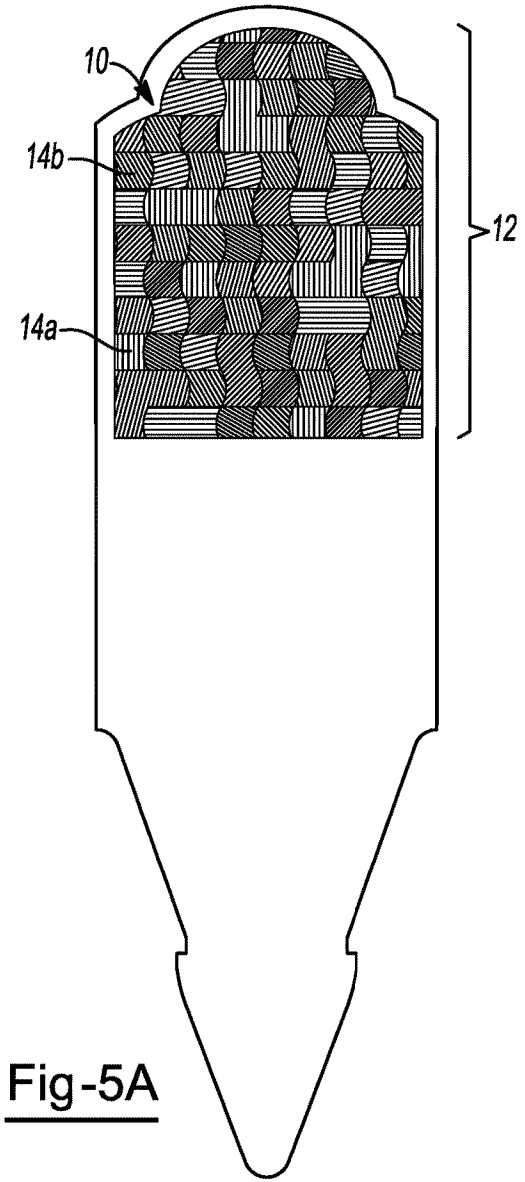
Figure 5F:
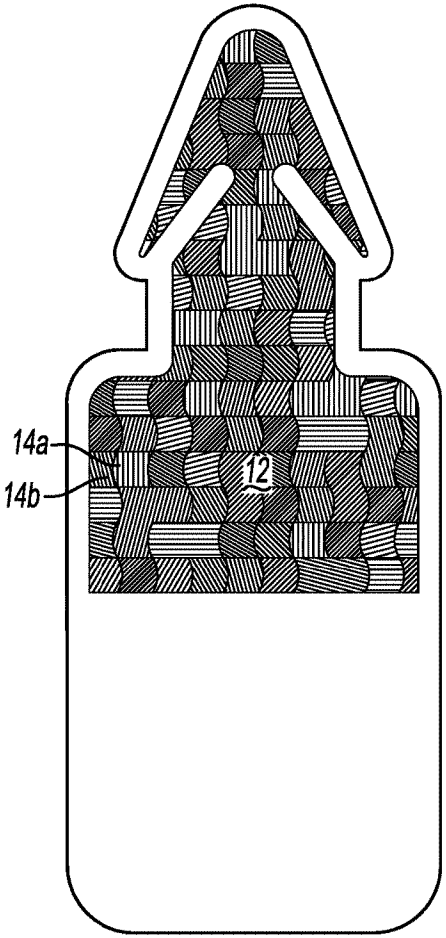
Figure 5E:
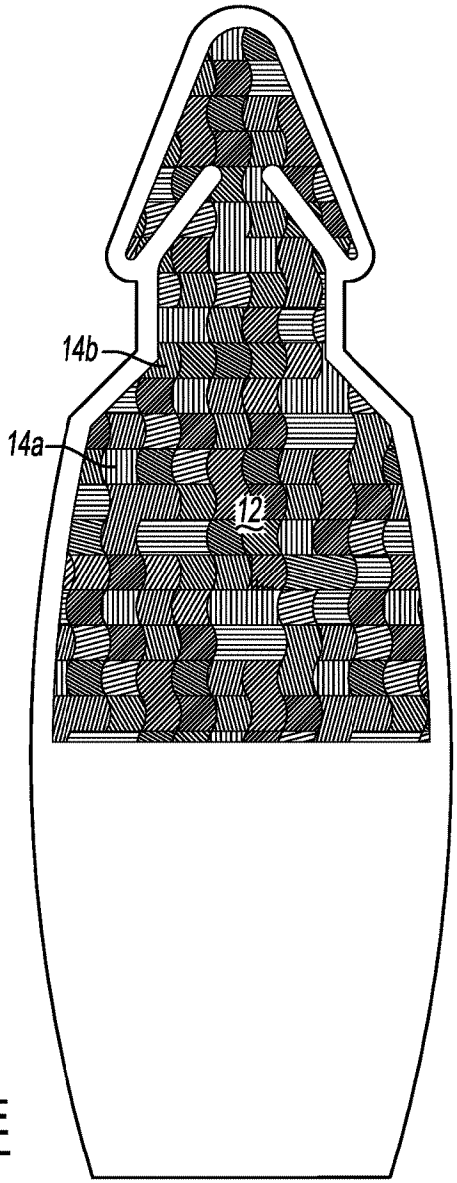
Figure 5D:
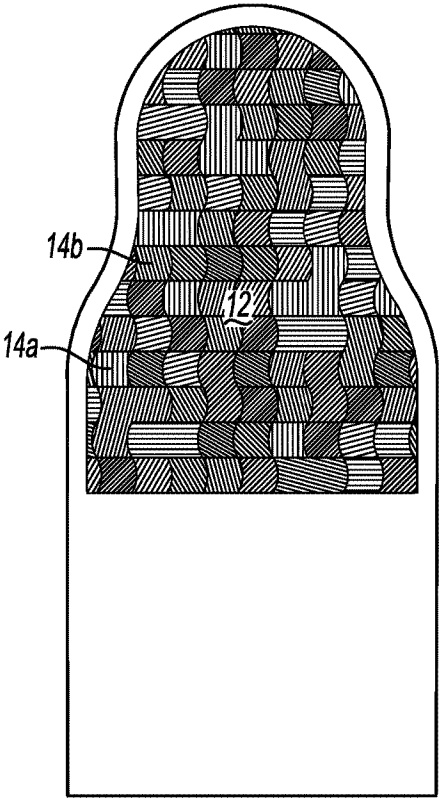

As shown for example in FIG. 3, the image 10 includes a greater pattern 12 defined by a series of repeating line patterns 14*a*-14*d*. FIGS. 4 and 5A-5F show use of the patterns described herein on specific shaped paperboard products. Though these products are shown as substantially planar. It is also possible that the printing described herein may be utilized with non-planar, curved or any variety of shaped products. The images 10 include a greater pattern 12, each defined by smaller repeating liner patterns 14*a*-14*b*.

Variations to the structures and features are also contemplated within the teachings. For example, any dimensions, angles, tolerances and/or proportions shown in the drawings are part of the teachings herein. Departures from the dimensions, angles, tolerances and/or relative proportions shown in the drawings are part of the teachings herein to the extent that such variations do not materially affect the intended operation or functionality of the depicted structures and features. For example, variations in an amount of less than 50%, 30% or 10% are envisioned; variations in an amount of more than 50%, 30% or 10% are also envisioned.

Unless otherwise stated or reasonably apparent from the context of the teachings, geometries may vary from those depicted in the drawings. Sharp corners at free ends of the structures may be rounded. Rounded corners at free ends of structures may be sharp.

The creases and/or scores depicted in the drawings may include perforations, or may be free of perforations. These may be located as depicted in the drawings or moved. Additional scores, creases and perforations may be may be added. Perforations may be omitted, or may be located intermittently or substantially entirely along a crease. For example, perforations may be located along only a portion of a crease (e.g., a total length of slit material being about 90% or less, about 60% or less, about 40% or less, about 20% or less, or about 10% or less).

Any of the various components of the container assembly may be formed from a single continuous sheet, or from one or more sheets. For example, a covering component, an insert component or a tray component may be formed of a first sheet that provides a structure to the component and a second sheet that covers some or all of the first sheet. As such, a second sheet may provide an aesthetic appearance to the component. A component of the container assembly may include sufficient support features, such as side wall connection features so that one or more of the side walls are maintained in a generally orthogonal orientation relative to the base portion, so that adjacent side walls are maintained in a generally orthogonal orientation relative to each other, or both. For example the container may include a sufficient number of support features so that the base portion and any pair of adjacent side walls are generally mutually orthogonal.

A sheet (i.e., a blank) for a component or element of the container may be formed by die cutting a sheet stock material. As such, the single continuous sheet may be a die cut preform for a container component. Any material suitable for folding, die cutting, or both may be employed. The sheet material may be a single layered material or may have multiple layers. For example the sheet may include a layer of a polymer, a layer of a paper, or both. A particularly preferred material is a paperboard. Any paperboard may be employed. The sheet material preferably has a thickness that is sufficiently low so that the sheet can be easily folded, die cut, or both. The thickness of the sheet material preferably is about 2 mm or less, more preferably about 1.5 mm or less, even more preferably about 1.2 mm or less, even more preferably about 1.0 mm or less and most preferably about 0.8 mm or less. The thickness of the sheet material preferably is sufficiently high so that the container can be assembled without having to fold an excessive number of layer (e.g., for forming a base). The thickness of the sheet material preferably is about 0.1 mm or more, more preferably about 0.2 mm or more, even more preferably about 0.25 mm or more, even more preferably about 0.30 mm or more, and most preferably about 0.35 mm or more. For example, the sheet material may be a paperboard characterized as about 8 point, 10 point, about 12 point, about 14 point, about 16 point, about 18 point, about 20 point, about 22 point, about 24 point, or about 26 point, about 28 point, about 30 point, or about 32 point.

The blank for a container may include regions having creases, regions having slits, regions having perforations, or any combination thereof. Creases preferably are employed in areas that provide a structural feature, such as a connection between two adjacent side walls. Creases are also preferably employed to allow easy folding, defined folding, or both in regions that will be visible in the assembled container. Preferably, the assembled container is free of visible slits or perforations. Perforations and/or slits preferably are employed for folding in regions that are not visible in the assembled container and may not be required to provide a structure between the areas on either side of the fold.

The container assemblies according to the teachings herein may be configured to receive one or more items for retail packaging purposes, for displaying purposes, for storage purposes, for transportation purposes, or any combination thereof. For example the container may be configured for receiving an electronic device (such as a consumer electronic device), a cosmetic, a perfume, a bonus gift, a key chain, jewelry, a kit, an article of clothing, a houseware item, an automotive accessory, paper goods, a food item, or any combination thereof.

The container assemblies according to the teachings herein may be used for a single-use packaging, or a multiple-use packaging. Preferably the packaging is a multiple use packaging.

Though not necessarily drawn to scale, geometries, relative proportions and dimensions shown in the drawings are also part of the teachings herein, even if not explicitly recited. However, unless otherwise stated, nothing shall limit the teachings herein to the geometries, relative proportions and dimensions shown in the drawing.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The invention claimed is:

1. A method for creating a greater pattern comprising:
(a) creating a first repeating line pattern comprising:
(i) printing a first line onto a substrate, the first line having a weight of from 0.2 point to 0.6 point;
(ii) printing a second line onto the substrate at least 0.3 point and less than 0.8 point from the first line, the second line having a weight of from 0.2 point to 0.6 point; and
(iii) printing a third line onto the substrate at least 0.3 point and less than 8 point from the second line, the third line having a weight of from 0.2 point to 0.6 point;
wherein the first, second and third lines are all printed at a first angle;
(b) creating a second repeating line pattern adjacent the first repeating line pattern;
(c) creating a third repeating line pattern adjacent the second repeating line pattern but not adjacent the first repeating line pattern; wherein the third repeating line pattern is printed at the first angle and the second repeating line pattern is printed at a second angle that differs from the first angle; and
(d) printing the first, second, and third repeating line patterns with a first curable coating and coating the first, second, and third repeating line patterns with a second curable coating, wherein the first curable coating is printed to form the greatest pattern and the second curable coating is applied under the greater pattern and self-registers into a second pattern that does not overlap with the greater pattern.

2. The method of claim 1, including coating the substrate using an anilox coater having a cell volume of less than 19.5 cm3/m2.

3. The method of claim 2, including coating the substrate using an anilox coater having a cell volume of greater than 15.5 cm3/m2.

4. The method of claim 1, wherein the first angle is about 90° relative to a bottom edge of the greater pattern.

5. The method of claim 2, wherein the anilox coater has a cell shape selected from hexagonal and diamond.

6. The method of claim 1, wherein the first line has a weight of from 0.3 point to 0.5 point.

7. The method of claim 1, wherein the second line has a weight of from 0.3 point to 0.5 point.

8. The method of claim 1, wherein the distance between the first line and second line is from 0.4 point to 0.7 point.

9. The method of claim 1, wherein the distance between the second line and third line is from 0.4 point to 0.7 point.

10. The method of claim 1, wherein each repeating line pattern within the greater pattern includes lines of the same weight.

11. The method of claim 1, wherein one or more repeating line patterns includes lines of a different weight as compared to an adjacent repeating line pattern.

12. The method of claim 1, including creating the third repeating line pattern adjacent the second repeating line pattern so that the second repeating line pattern lies in between the first repeating line pattern and third repeating line pattern.

13. The method of claim 12, wherein no two adjacent repeating line patterns are drawn at the same angle.

14. The method of claim 1, wherein the shape of the first repeating line pattern is the same as the shape of a second repeating line pattern.

15. The method of claim 1, wherein the shape of the first repeating line pattern is different than the shape of the second repeating line pattern.

16. The method of claim 1, wherein the second angle is less than 45° from the first angle.

17. A method for creating a greater pattern comprising:
(a) creating a first repeating line pattern comprising:
(i) printing a first line onto a substrate, the first line having a weight of from 0.2 point to 0.6 point;
(ii) printing a second line onto the substrate at least 0.3 point and less than 0.8 point from the first line, the second line having a weight of from 0.2 point to 0.6 point; and
(iii) printing a third line onto the substrate at least 0.3 point and less than 0.8 point from the second line, the third line having a weight of from 0.2 point to 0.6 point;
wherein the first, second and third lines are all printed at a first angle;
(b) creating a second repeating line pattern adjacent the first repeating line pattern and a third repeating line pattern adjacent the second repeating line pattern but not adjacent the first repeating line pattern; wherein the third repeating line pattern is printed at the first angle and the second repeating line pattern is printed at a second angle that differs from the first angle; and wherein the first, second, and third repeating line patterns each have the same size and shape to form the greater pattern; and
(c) coating the substrate using an anilox coater having a cell volume of greater than 15.5 cm3/m2.

18. The method of claim 17, including printing the second repeating line pattern in between the first and third repeating line pattern.

19. The method of claim 1, wherein the first curable coating is a varnish and comprises:
(i) at least one acrylate monomer;
(ii) an acrylate oligomer with a backbone that comprises one or more groups selected from epoxy, polyester, urethan, acrylic, and silicone;
(iii) a photoinitiator; and
(iv) a surface tension lowering additive.

20. The method of claim 1, wherein the second curable coating comprises:
(i) at least one acrylate monomer;
(ii) an acrylate oligomer with a backbone that comprises one or more groups selected from epoxy, polyester, urethane, acrylic, and silicone;
(iii) a photoinitiator; and
(iv) a self-assembling additive that prevents flow and promotes self-retracting.

* * * * *